US006711876B1

(12) United States Patent
Benedetti

(10) Patent No.: US 6,711,876 B1
(45) Date of Patent: Mar. 30, 2004

(54) APPARATUS FOR ATTACHING A TAG AND A THREAD TO A FILTER BAG

(75) Inventor: Oliviero Benedetti, Faenza (IT)

(73) Assignee: Teamac S.r.l., Bologna (IT)

( * ) Notice: Subject to any disclaimer, the term of this patent is extended or adjusted under 35 U.S.C. 154(b) by 0 days.

(21) Appl. No.: 10/070,327

(22) PCT Filed: Aug. 29, 2000

(86) PCT No.: PCT/IB00/01218

§ 371 (c)(1),
(2), (4) Date: Mar. 5, 2002

(87) PCT Pub. No.: WO01/19682

PCT Pub. Date: Mar. 22, 2001

(65) Prior Publication Data

(65)

(30) Foreign Application Priority Data

Sep. 15, 1999 (IT) ..... M199A1919

(51) Int. Cl.[7] ..... B65B 61/14

(52) U.S. Cl. ..... 53/134.2; 53/134.1; 493/375; 493/379; 493/388; 493/399; 493/961

(58) Field of Search ..... 493/375, 379, 493/388, 389, 393, 139.4, 376, 926, 961, 163, 164, 175; 53/134.2, 413, 134.1

(56) References Cited

U.S. PATENT DOCUMENTS

| | | | | | |
|---|---|---|---|---|---|
| 4,288,224 | A | * | 9/1981 | Romagnoli | 493/345 |
| 5,399,224 | A | * | 3/1995 | Vernon et al. | 156/324 |
| 5,893,256 | A | * | 4/1999 | Ghirlandi | 53/134.2 |
| 5,979,144 | A | * | 11/1999 | Bailey et al. | 53/413 |
| 6,050,059 | A | * | 4/2000 | Rea | 53/413 |
| 6,216,620 | B1 | * | 4/2001 | Shepard | 112/475.17 |
| 6,453,639 | B1 | * | 9/2002 | Sgubbi | 53/134.2 |
| 6,499,273 | B1 | * | 12/2002 | Marzocchi | 53/413 |

* cited by examiner

*Primary Examiner*—Rinaldi I. Rada
*Assistant Examiner*—Gloria R Weeks
(74) *Attorney, Agent, or Firm*—Notaro & Michalos P.C.

(57) ABSTRACT

This invention describes a two-wheeled apparatus with rotating translators means and multiple pincers for the packaging tag connected to the terminal free end of a handling thread, whose other free end is fixed to the bag itself.

7 Claims, 5 Drawing Sheets

APPARATUS FOR ATTACHING A TAG AND A THREAD TO A FILTER BAG

Figure 1:
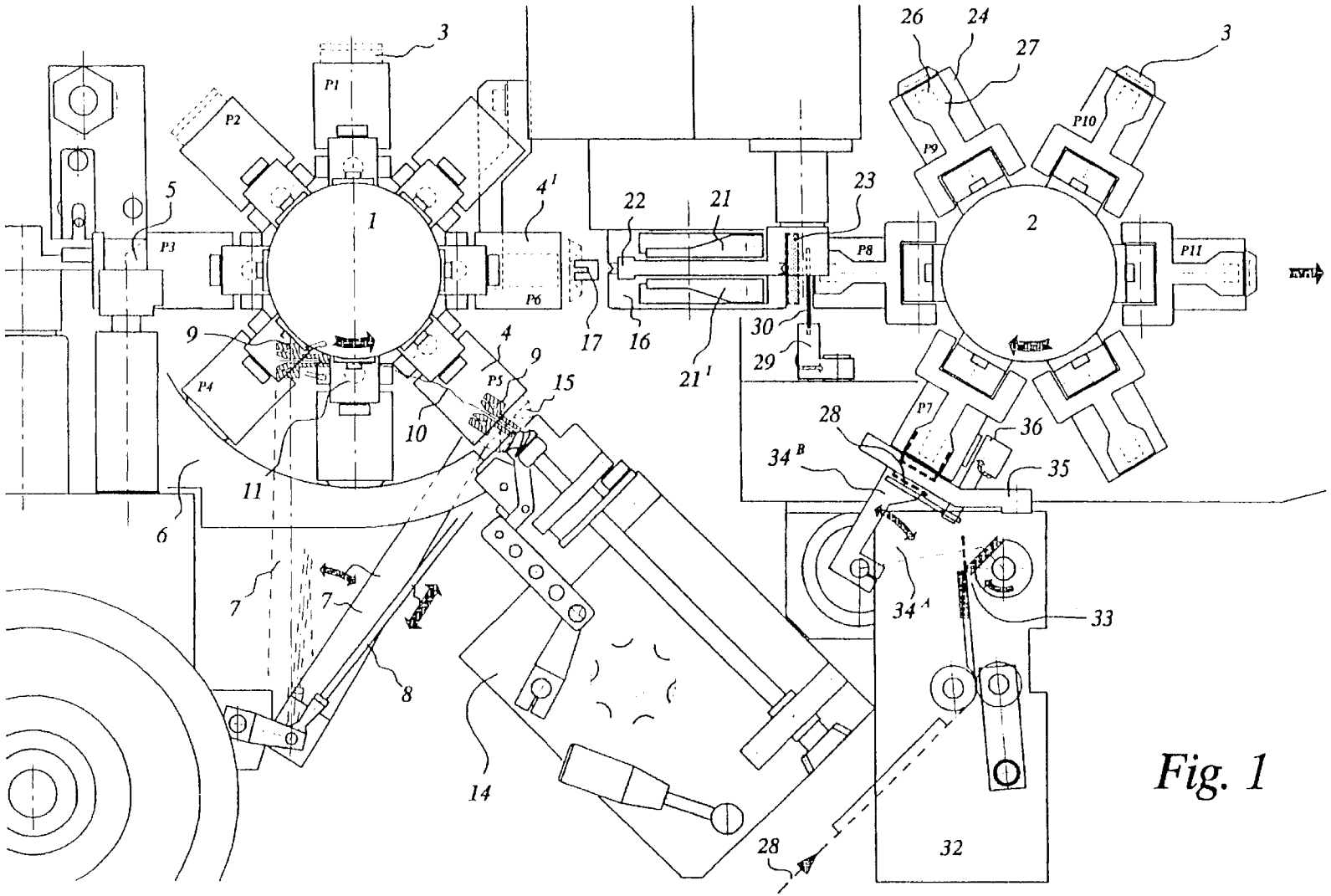

This invention refers to a two-wheeled apparatus for the packaging of filter bags containing an infusion product, fitted with a grasping tag connected to the one end of a handling thread, whose other end is attached to the same bag.

The apparatus comprises two wheels, with multiple pincers, rotating intermittently in opposing directions. The first wheel is rotated in a counterclockwise and the second one in a clockwise direction, while progressively associating with various work stations designed to feed the filter bag, associate the handling thread to the filter bag, attach the thread to the bag, transfer the bag from the first to the second wheel, wrap the thread around the bag, and simultaneously associate the grasping tag to both the thread and the bag. In particular, the invention refers to a filter bag of a so-called bilobate type, where the infusion product is localized in two closed chambers ending at the bottom in a "W" shape fold. The invention may also be applied to an eventual one-labe bag of a type which allows it to be produced in a apparatus as described in this invention. The known art envisions various methods for the packaging of filter bags and the attaching of the thread to the bag and the tag, by using apparatus and devices differing from case to case. A known solution is to produce filter bags coated with a heat-sealing layer of thermoplastic material, where the thread is attached to the bag by heat-sealing it between the upper edges. Another solution is a filter bag which is always coated by a thermal sealing material, where the thread is attached at one end to the bag by a thermoplastic stamp, and at the other end to the tag by an additional thermoplastic stamp. These two solutions evidence two serious drawbacks: the first refers to a migration of the infusion of substances originating from the thermoplastic layer, and the second to the high cost of the thermally sealed paper with respect to that of a normal-filter paper. Another known solution is the packaging of the filter bag by using metallic staples to fasten the thread to the bag and tag, a solution which is inconvenient due to the alteration of the infusion's organic taste characteristics induced by the metal.

Another known solution is to anchor the free end of the thread of the bag by knots, or stitched seams similar to knots or simple linear stitched seams. The available documents make it evident however, that the known art teaches little about the production of industrial] apparatus capable of automating the packaging of filter bags by using these last solutions.

German patent DE 1 229 895 discloses an apparatus, belonging to the prior art, to feed and fix a handling thread to the tag, in a first station, and anchor both thread and tag to the bag in a second station.

The Italian patent application no. M199A000976 in the name of the same Applicant describes a mechanical device for executing multiple Knots, in a sequential manner, of differentiated size and at variable speed, and therefore capable of producing filter bags on an industrial scale and with a broad versatility and flexibility, complete with handling threads and tag, without incurring in any of the drawbacks of the known solutions mentioned above, and without requiring metallic staples as fastening means.

The purpose of the present invention is to disclose an apparatus comprising two wheels, carrying specific devices, apt to anchor, by a series of multiple knots, an handling thread to the top flap of a filter bag, simultaneously closing it, (in the first wheel) and to fix a tag to the other free end of the thread by welding (in the second wheel).

This purpose is achieved by the characteristics derived from the claims outlined below, which will become more evident from the detailed description given in the text and in the attached drawings, which also point to another great advantage of the invention: the simplicity of production and the rational kynematic layout of the diagram, deriving from the elimination of the two systems feeding metallic staples between the bag and thread and the tag and thread), which translates in practice to lower production costs for the entire apparatus, to its improved reliability and to some greater operating energy savings for the final user.

Further characteristics and advantages of the invention will be better evidenced in the course of the detailed description that follows, with reference to the attached drawings in which:

FIG. 1 depicts a front view of the entire apparatus, complete with all its work stations and operating units, placed on the two heads rotating in the opposite directions (1) and (2).

Figure 2:
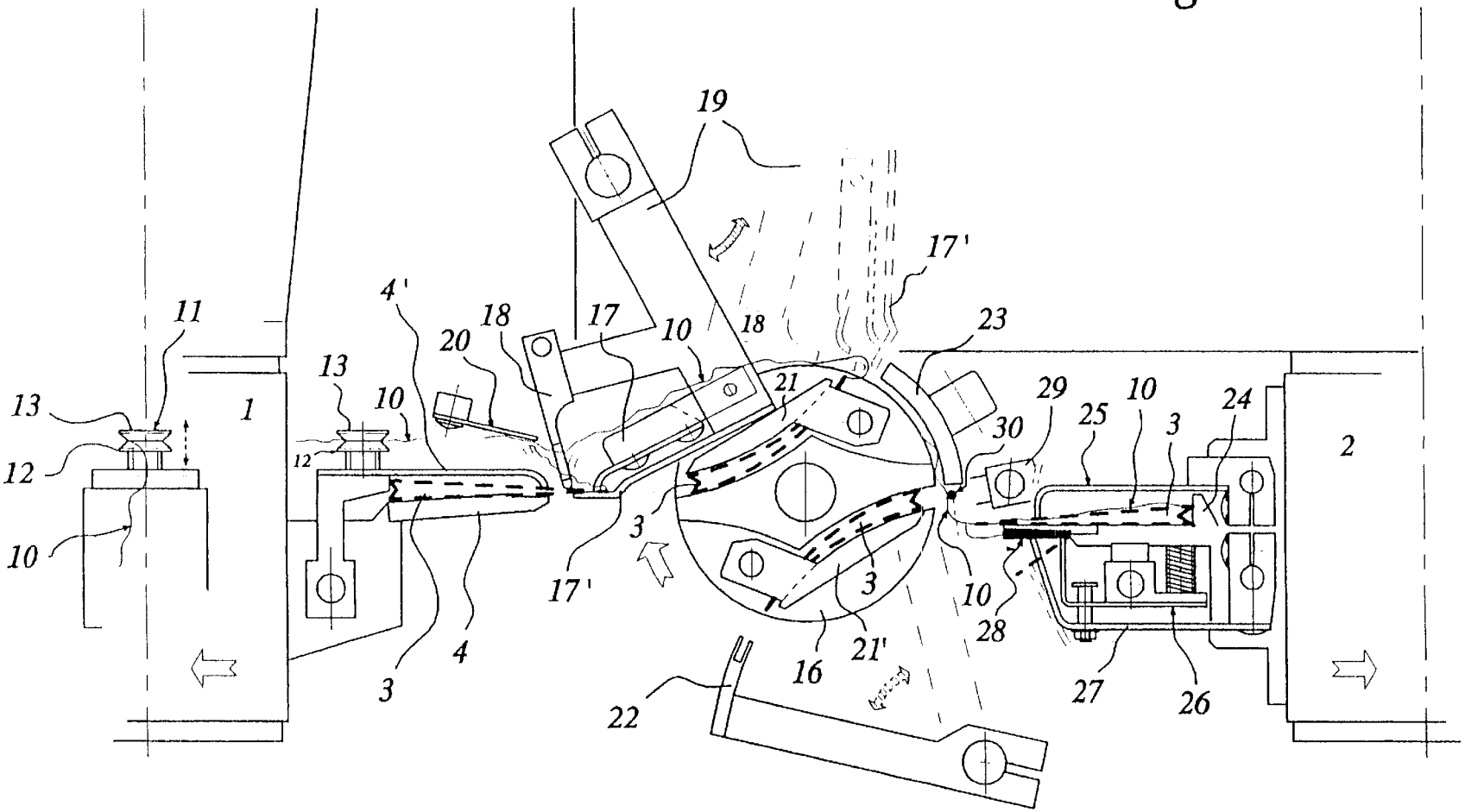

FIG. 2 offers a ground view of the apparatus, with particular reference to the translating motion of the filter bag (3) from wheel (1) to wheel (2), by using the rotating translator (16).

Figure 3:
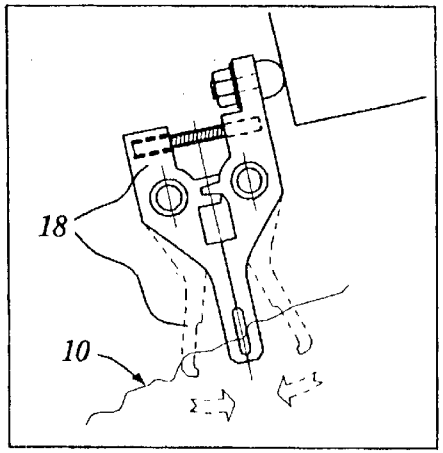

FIG. 3 offers a ground view of a detail relating to the mobile thread-guiding pincer.

Figure 4:
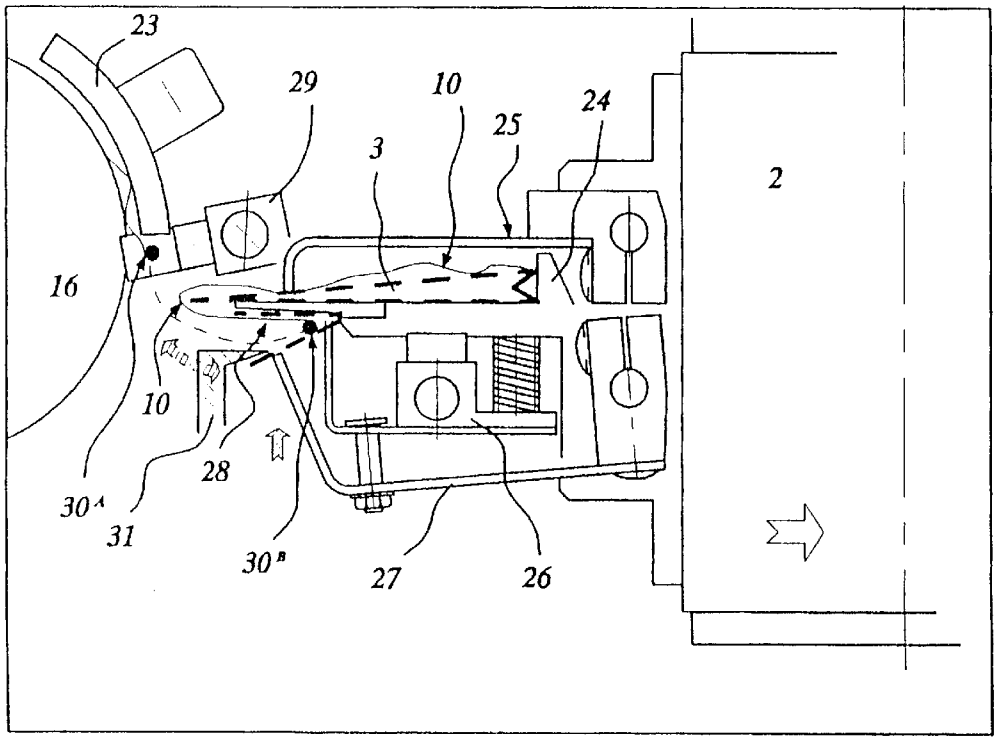

FIG. 4 offers a ground view of a detail relating to the insertion of the thread (10) into the tag (28).

Figure 5:
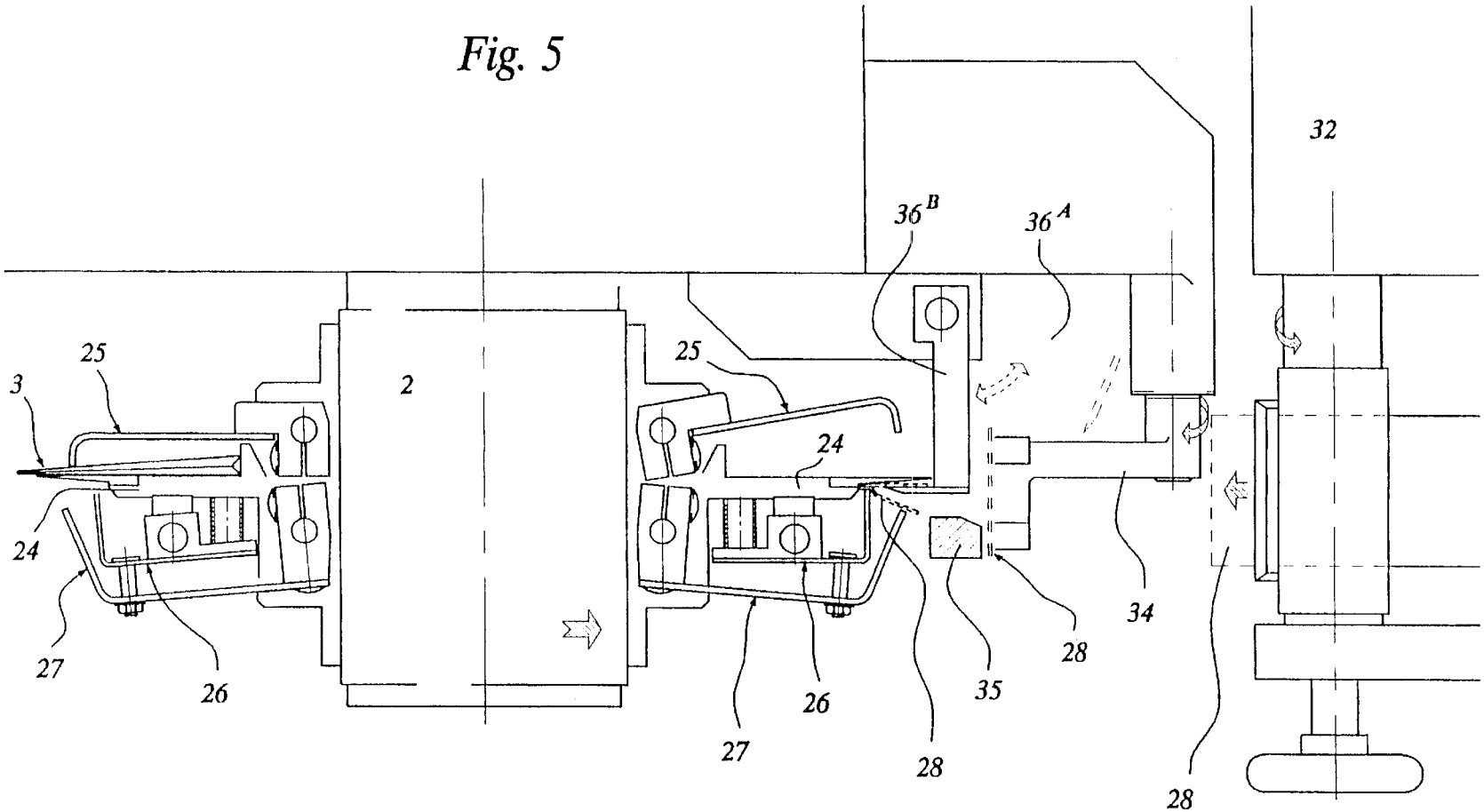

FIG. 5 offers a ground view of the loading of the tag (28) onto the wheel (2), for its subsequent association with the bag (3).

Figure 6:
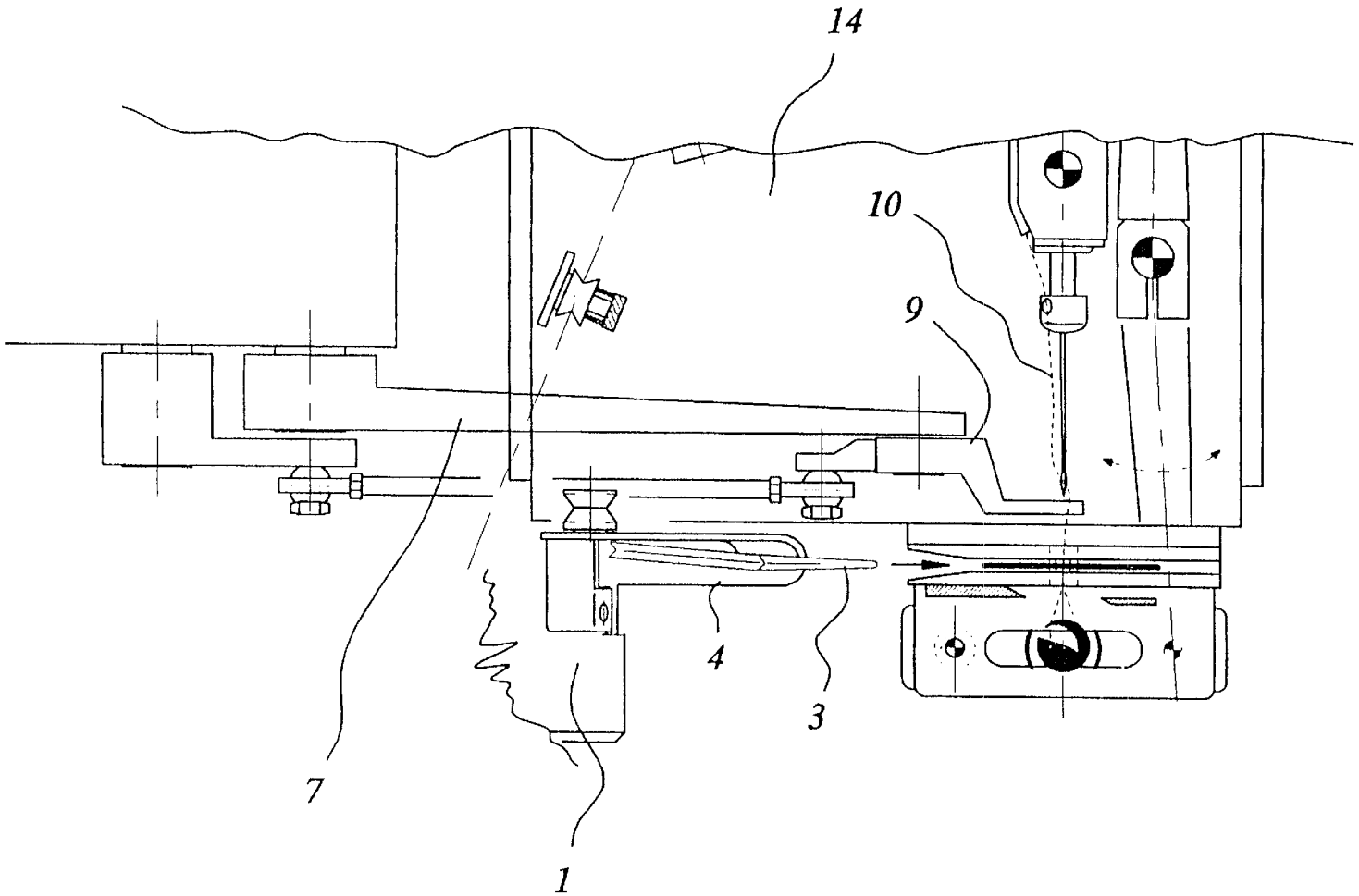

FIG. 6 depicts a detail of the ground view of the combination of the apparatus (14) with the rotating wheel (1).

In accordance with FIG. 1, the invention refers to a apparatus which is essentially constituted by a first wheel (1) rotating intermittently in a counterclockwise direction and fitted on its circular surface with a number of pincers composed of a fixed portion (4) and a mobile portion (4'). During a stoppage of the wheel (1), an appropriate oscillating pincer, not shown in FIG. 1, conveys and positions the bag (3) on the wheel (1). When the bag is conveyed to the station (P1) it is already formed, so that the bellows on its 2 bottom allow the pincers (4) to exit from the upper edge, which must be folded for closing. In the stations (P3) and (P4), a number of folding devices take care, by a known art, of folding the edge of the filter bag by two lateral folds and subsequently by a final closing flap folded back upon itself. A further rotation of the wheel (1) by 45° translates the filter bag (3) to the fastening station (P5), where the mentioned bag arrives with its upper edges completely folded. Due to the particular position assumed by the filter bag (3) as a result of the rotation of the wheel (1) (bottom of the bag turned inward, and head of the same turned outward), the top flap of the bag (3) comes to be inserted into a stationary funnel which is part of the apparatus (14) described in the Italian patent application N. M199A000976 in the name of the same Applicant.

As shown in FIG. 6, which represents a detail of a combination of the apparatus (14) with the device of this invention, in the standby position (15) the needle of the apparatus (14) is ready to close the top flap of the bag (3), by offering a length of thread (10) protruding from the eye of the same needle. In this precise instant, the lever (7) shown in FIG. 1 and FIG. 6 closes the pincer (9), by using the mobile rod (8), on the length of thread protruding from the extremity the needle and moves by an oscillating motion to the position (7), while pulling along a length of thread long enough to wrap the thread itself around the bag (3).

As seen in the FIGS. 1 and 2, the length of the thread (10) pulled by the pincer (9) is inserted into a pulley (11) placed on and attached immediately behind the mobile pincer (4'). This pulley is constituted by two friction surfaces (13) and (12), one fixed (12) and the other one mobile (13) opposed to each other and elastically spread apart by a spring. In this manner the thread inserted between the two friction elements of the pulley (11) remains appropriately stretched and allows the needle positioned in the station (P5) to perform the operation of anchoring its other free extremity to the upper edge of the bag (3) and to simultaneously close the upper flap of the mentioned bag (3), thus producing, in combination with the apparatus (14), a linear series of multiple sequential knots without surrounding the closing flap, which eliminates the need for any additional auxiliary fastening devices. After the bag's closing operation described above, the pincer (4) moves to the position (4') and during this motion also pulls along the thread (10), whose one extremity is anchored to the top fold of the bag (3) and the other free extremity is stretched between the elements (13) and (12) of the pulley, as can be seen in the ground view of FIG. 2. With reference to the FIG. 2, at the same instant at which the bag (3) is in the position just described, the pincer (18) mounted on the oscillating lever (19) and carrying an eyelet at its extremity, as clearly shown in the detail of FIG. 3, closes and imprisons the free end of the thread (10) in its eyelet. At the same moment, the stationary pincer (17') and the mobile pincer (17) mounted on the oscillating lever (19) grasp the bag at its upper flap and move it inside the stationary funnel (21) of the rotating device (16), thus forcing the thread (10), while still locked inside the eyelet of the pincer (18), to turn around the rotating device (16). Once the bag (3) is placed inside its stationary funnel (21), the device (16), as shown in FIG. 2, takes care of performing a 180° rotation, thus moving the bag (3) to the position (21) and simultaneously allowing the thread (10), with the aid of the stationary support (23), to remain wrapped in a stretched condition around its circular surface. As refers to the thread (10), it should be noted that in this position it presents a free extremity which is already anchored to the top flap of the bag, while the rest of its length is stretched out half along the longitudinal edge of the bag adhering to the outer wall of the funnel (21), and half along the internal guide of the support (23), as shown in the FIGS. 1 and 2. At this moment the bag (3) is already in a condition ready to be inserted in the successive wheel (2), which completes the wrapping of the thread (10) around the bag itself, and at the same time associates a grasping tag to another free extremity of the thread (10), which is lightly attached to the bag to prevent it from swinging about. Before describing the mentioned operations, however, it is preferable to describe the feeding and loading operation of the tag on the w-heel (2). With reference to the FIG. (1), the tag is fed and loaded by the device (32), which is apparently shifted to a work station of the rotating wheel (2). More exactly, a continuous ribbon spool (28) is moved up to a cutting station (33), where the action of two knives, one of a stationary and the other of a mobile type, cuts off a piece of the tag (28) in a conventionally known manner. At the moment of cutting, an oscillating lever (34) carrying an aspirating device at its upper extremity picks up the tag (28) and shifts it from the position (34*a*) to the position (34*b*), just above a work station of the wheel (2) constituted by a series of multiple pincers which take care of seating and associating the tag with the thread and the bag. FIG. 5 shows this operation in detail.

While recalling the above description of cutting and grasping the piece of tag (28), FIG. 5 offers a ground view of the oscillating lever (34) which picks up the tag (28) from the device (32) by suction, so as to position it to face the multiple pincer station of wheel (2).

It should be observed at this point the multiple pincer station is constituted by the stationary pincer (24) and the mobile pincer (25), capable of successively seating the filter bag coming from its packing emplacement in the device (16). The stationary pincer (24) has on the outer side of its upper length a slightly sloping surface ending in a small step, suitable for successively seating the lower flap of the tag.

This station is completed by the two mobile pincers (26) and (27), the first one capable of blocking the tag folded on the bottom of the step of the pincer (24), and the second capable of blocking the tag after introducing the thread (10). After this clarification and with reference to FIG. 5, the tag (28) to be grasped and positioned in its stretched-out configuration on the lever (34) is inserted and simultaneously folded in a "V" shape by the combined action of the folding device (36) and of the stationary funnel (35). By an oscillating motion, this folding device starts from a resting position (36*a*), meets a tag along a longitudinal axis which is slightly offset with respect to its center line, and while continuing in a rotary sliding motion folds the tag (28) in cooperation with the mobile pincer (25), thus shifting it to its end-stop with the bottom resting against the surface of the step of the pincer (24). This starts the mobile pincer (26), which firmly blocks the tag (28) on the pincer (24), while the tag itself is still open in a "V" type fashion and the mobile pincer is also fully open.

In this specific configuration, the multiple pincer station of the wheel (2) performs a 60° rotation, to move itself on top of the device (16) where the bag (3) has been shifted to (see FIG. 2), after having been partially packaged with the thread moved up to its top flap.

With reference to the FIGS. 2 and 4, it can therefore be observed that in the mentioned configuration, while the pincer (25) is still open, the bag (3) is translated, by the rotating oscillation of the support (22), from the funnel (21') to the pincer (24), where, after its final shifting, it is blocked by the closing action of the mobile pincer (25). It is worth noting that during the translation from the funnel (21') to the pincer (24), the bag (3) pulls along, in a wrapping configuration, the length of thread (10) which is still seated in the inner guide of the stationary funnel (23) (See FIGS. 2 and 4). In this packaging configuration the bag is entirely shifted inside and between the pincers (24) and (25), with the thread (10) wrapped around itself, while of the two extremities of the thread (10), the first one is anchored to the top flap of the bag, and the second one protrudes in a vertical position from the upper edge of the bag for a sufficient length to allow it to be subsequently inserted and anchored into the tag. With reference to the FIGS. 2 and 4, it should be noted that after inserting the bag between the pincers (24) and (25), the system actuates an oscillating lever (29) which carries at its extremity a fixed pin (30) perpendicular to its oscillating plane and therefore perpendicular to the rotating plane of the device (16). Before actuating the lever (29), its pin is exactly in the position (30*a*) (see FIG. 4) where it meets the length of thread (10) positioned vertically on the edge of the bag. It is intuitively grasped that the pin (30) takes care, while rotating from its position (30*a*) to the position (30*b*), to displace the last free length of thread inside the still open "V" shaped tag, which is blocked by the pincer (26).

After returning the pin (30) to its original position (30*a*), the mobile pin (27) takes care of closing the tag upon itself, and to block the lower half of the same tag containing the terminal part of the thread (10) in its interior.

It should be noted that after closing the mobile pincer (27), the upper half of the tag is free of any grasping restraints. Because of the fact that the bottom fold has been performed outside the center line by the folder (36), (see FIG. 5), the tag (28) is also left with its upper edges short of forming a perfect fit, so that a small linear length of about half a millimeter of its internal surface is directly resting on the top edge of the bag. In this packaging configuration the wheel (2) performs a further clockwise rotation of 60°, so as to move the multiple pincer station (24), (25), (26) and (27) to the subsequent working position, where a device comprising a series of thermal welding devices, not shown in FIG. 1, tales care of thermally pressure-welding the fitting surfaces of the tag containing the thread, and at the same time of laying down a fixed thermal welding line to fasten the non-fitting surface length of the tag directly to the top fold of the bag (3). This description evidences that a further advantage of the apparatus described by this invention is in its versatile process layout, which allows using, without appreciable modifications, certain traditional fastening devices such as for instance metallic staples or others, provided that such solutions are not considered harmful to the end-user. This is to essentially emphasize that the apparatus with on rotating-translators means and multiple pincers described above allows associating a grasping tag and a handling thread to a filter bag in its packaging arrangement, even if the apparatus (14), which is designed for a particular type of fastening means, is replaced by a different system designed for fastening means other than those described above.

The invention based on this design may be susceptible to numerous modifications and variants, all of which are however falling within the scope of the inventive idea contained in the following claims.

What is claimed is:

1. An apparatus for packaging of filter bags for infusion products capable of associating a grasping tag and a handling thread to a filter bag in a packaging arrangement thereof, the apparatus comprising:

a first rotating wheel (1) having a circular surface and a first series of pincers carried on the circular surface of the first wheel;

a second rotating wheel (2) having a circular surface and a second series of multiple pincers carried on the circular surface of the second wheel, each one of the multiple pincers of said second series being composed of a stationary pincers (24), a mobile pincers (25) and two further mobile pincers (26) and (27);

an anchoring station (P5) for anchoring a handling thread (10) to a top flap (15) of a filter bag (3), that comprises: first feeding means for feeding the thread (10) up to a point next to the top flap (15) of the filter bag; second picking means for picking up a well defined length of the thread (10); and third stretching means for stretching the thread (10), said second picking means seating after appropriate rotary oscillation the thread length between said third stretching means, said thread being subject to the action of said first feeding means being adapted to anchor a free terminal end of the handling thread to the top flap (15) anchoring methods comprising knotting or sewing, while the other free terminal end of the thread (10) remains anchored to grasping means of mobile pincers (9) and of a pulley (11), said first feeding means comprising a needle with an eye, said second picking means comprising said mobile pincers (9) fixed to a lever (7) and said third stretching means comprising said pulley (1 1) equipped with clamping elements (12) and (13);

a picking station (P6) for picking up said filter bag (3) and for inserting the filter bag into a stationary funnel (21), and holding said thread (10) in a stretched form on the outer surface of a mobile pincers (4') during translation of the bag to the funnel (21), that comprises: first picking means for picking up said filter bag and inserting the filter bag into the funnel (21); second locking means for locking and guiding the thread (10); and third stretching means for stretching said thread (10) on an outer surface of said mobile pincers (4'), said first picking means comprising a first pincers (17), fixed to an oscillating arm (19), said second locking means comprising a second pincers (18) fitted with an eyelet closed at an extremity thereof and fixed to the same oscillating arm (19) and said third stretching means comprising an elastic leaf (20) for holding said thread (19) in a stretched form during translation of the bag to the funnel (21), in cooperation with said second pincers (18);

shifting means for shifting the bag to a laid-out position inside the stationary funnel (21) while maintaining the thread (10) stretched around a circular surface of said funnel, into and between the stationary and mobile pincers (25, 24) of the second wheel (2), said shifting means comprising a rotating device (16) which performs a rotation of 180°, a stationary support (23) for slowing down the thread (10), in cooperation with said rotating device (16) and an oscillating pusher (22) that, performing a swinging movement, pushes said filter bag (3), displacing the bag into and between said stationary and mobile pincers (25, 24) of the second wheel (2), said first series of pincers engaging in successive phases said anchoring and picking stations (P5) and (P6) and said shifting means;

a positioning station (P7) for frontally positioning, next to said stationary pincers (24), a previously cut-off piece of a tag (28), that comprises: an oscillating arm (34) being provided for feeding said piece of tag (28), frontally positioning the piece of tag next to the stationary pincers (24), folding the piece of tag (28) in a V-shaped manner and inserting the piece of tag in an external plane of the stationary pincers (24), the positioning station (P7) comprising: an oscillating insertion device (36) that acts, in combination with a stationary funnel (35) where said mobile pincers (26) of said second pincers series firmly blocks the insertion device next to a bottom of said pincers (24);

an insertion station (P8) where the filter bag (3) has already been inserted between the mobile pincers (24, 25) and the piece of tag (28), with the V-shape pattern, said insertion station (P8) being adapted to insert the other terminal free end of the thread (10) inside the still open V-shaped tag, and comprising: an appropriate pin (30) that is movable by angular oscillating motion and is fixed to an arm (29), and is adapted to close said tag (28); and a mobile pincers (27) for closing and blocking two open arms of the V-shaped piece of tag (28); and a welding station (P9) for thermally welding the fitting internal surfaces of the piece of tag (28) and blocking the thread (10) therein and, at the same time, fastening with a light thermal weld, a short length of an internal surface of the piece of tag directly onto the bag, so as to prevent the bag from swinging about; and appropriate thermal welding devices, said second series of pincers engaging said positioning, insertion and welding stations (P7), (P8) and (P9).

2. An apparatus according to claim 1, wherein, at the anchoring station (P5), anchoring means of the free terminal end of the thread (10) to the top flap (15) of the filter bag (3) comprises a metallic staple.

3. An apparatus according to claim 2, comprising an oscillating arm (29), carrying at an extremity thereof a fixed pin (30), in an essentially perpendicular position to a plane of rotation of said arm (29), said fixed pin (30) for inserting the free terminal length of Ute thread (10) between the internal surfaces of the tag (28) and simultaneously surrounding a head and a top fold of the bag with the thread (10), during rotation of the pin (30) from a first position **(30*a*) to a second position (30*b*)**.

4. An apparatus according to claim 1, wherein the anchoring station (P5) is equipped with a device (14) for applying on the closing flap of the filter bag (3), without surrounding said flap, a number of multiple sequential knots of a constant or differentiated linear size.

5. An apparatus according to claim 1, in which the filter bag (3), with the thread (10) anchored on its top flap (15), is translated from the picking station (P6) to the funnel (21), wherein the apparatus provides translation means for performing translation of the filter bag (3) from the picking station (P6) to the funnel (21) in such a manner that the thread (10) comes to be with part of its length stationing in tension and longitudinally along a lobe of the bag in contact with the internal surface of the funnel (21), and a remaining terminal length of thread imprisoned and still held in the eyelet of the oscillating pincers (18), and wherein said translation means comprise: said first pincers of said picking means of the picking station (P6) fixed on the oscillating arm (19) that clamps the top flap (15) of the filter bag; said second oscillating pincers (18) of said locking means of the picking station (P6) that imprisons the terminal end of the thread; and said elastic leaf (20) that holds said thread (10).

6. An apparatus according to claim 1, wherein said stationary support (23) working in association and in combination with the outer surface of said rotating device (16) is fitted along a longitudinal extension of an internal surface thereof with a fixed guide, carved out in a V pattern from a same surface, that is adapted for keeping the thread (10) in a guided and stretched-out position while inserting the filter bag (3) into said second series of multiple pincers of the second rotating wheel (2), performed by said oscillating pusher (22).

7. An apparatus according to claim 1, wherein said series of multiple pincers of the second rotating wheel (2) is constituted: of the stationary pincers (24) that has and internal surface essentially perpendicular to a rotary axis of the wheel (2) and of an entirely linear shape, an outer surface whereof being fitted with an upper slightly sloping length ending at a bottom part in a length protruding in the form of a step! so as to allow outer seating of the tag (28); of the mobile pincers (25) that are adapted to lock the bag on an inner surface of the stationary pincers (24); of the further mobile pincers (26) that is adapted to block the piece of tag (28) on the bottom thereof and in a closing position perfectly fitting into said step that is carved out on the outer surface of the stationary pincers (24); and of the further mobile pincers (27) that is adapted to simultaneously close the piece of tag (28) and to block a free terminal end of the thread (10) between the internal surfaces of the same piece of tag (28).

* * * * *